United States Patent [19]

Dimier et al.

[11] Patent Number: 4,998,747

[45] **Date of Patent: * Mar. 12, 1991**

[54] MODIFIED UNIVERSAL SKI BINDING FOR USE WITH DIFFERENT SKI BOOTS, AND BOOTS SPECIFIC TO CERTAIN BINDINGS

[75] Inventors: Jean-Pierre Dimier, Rumilly; Roger Pascal, Annecy Le Vieux, both of France

[73] Assignee: Salomon S.A., Annecy Cedex, France

[ * ] Notice: The portion of the term of this patent subsequent to May 24, 2005 has been disclaimed.

[21] Appl. No.: 81,034

[22] Filed: Aug. 3, 1987

Related U.S. Application Data

[63] Continuation of Ser. No. 690,882, Jan. 14, 1985, Pat. No. 4,746,139.

[30] Foreign Application Priority Data

Jan. 12, 1984 [FR] France ..... 84 00390

[51] Int. Cl.[5] ..... A63C 9/084

[52] U.S. Cl. ..... 280/631; 280/634

[58] Field of Search ..... 280/618, 620, 625, 631, 280/632, 637, 634; 36/117

[56] References Cited

U.S. PATENT DOCUMENTS

| | | | |
|---|---|---|---|
| 3,448,989 | 6/1969 | Marker | 280/637 |
| 3,709,509 | 1/1973 | Hildebrand | 280/631 |
| 4,168,084 | 9/1979 | Van Besser et al. | 280/618 |

FOREIGN PATENT DOCUMENTS

| | | |
|---|---|---|
| S278608 | 2/1970 | Austria . |
| S307939 | 6/1973 | Austria . |
| 349369 | 4/1979 | Austria . |
| 355961 | 4/1980 | Austria . |
| 368899 | 11/1982 | Austria . |
| 2041239 | 3/1972 | Fed. Rep. of Germany . |
| 2038995 | 3/1974 | Fed. Rep. of Germany . |
| 2808131 | 9/1979 | Fed. Rep. of Germany . |
| 1487281 | 6/1967 | France . |
| 2370489 | 6/1978 | France . |
| 8000863 | 7/1981 | France . |
| 2497110 | 7/1982 | France . |
| 8202057 | 8/1983 | France . |
| 8310819 | 12/1984 | France . |
| 8310989 | 1/1985 | France . |
| 2555907 | 6/1985 | France . |

OTHER PUBLICATIONS

DIN 7880 Ski Boots for Ski Bindings for Alpine Downhill Skiing, 1/1 1984.

ONORM S4036, Ski Boots for Ski Bindings for Alpine Skiing, May 1, 1982.

*Primary Examiner*—Charles A. Marmor
*Assistant Examiner*—Richard Camby
*Attorney, Agent, or Firm*—Sandler, Greenblum & Bernstein

[57] ABSTRACT

A ski boot, and a binding for binding the ski boot onto the ski. The boot is provided with blocking means which prevents its attachment by bindings other than those which should properly be used with the specific boots. The binding itself however is capable of use with any standardized boot, whether or not it has blocking means. This assures that boots requiring specially modified bindings will not be used otherwise, but nevertheless permits the use of such boots with bindings used with standardized boots having no blocking means.

90 Claims, 9 Drawing Sheets

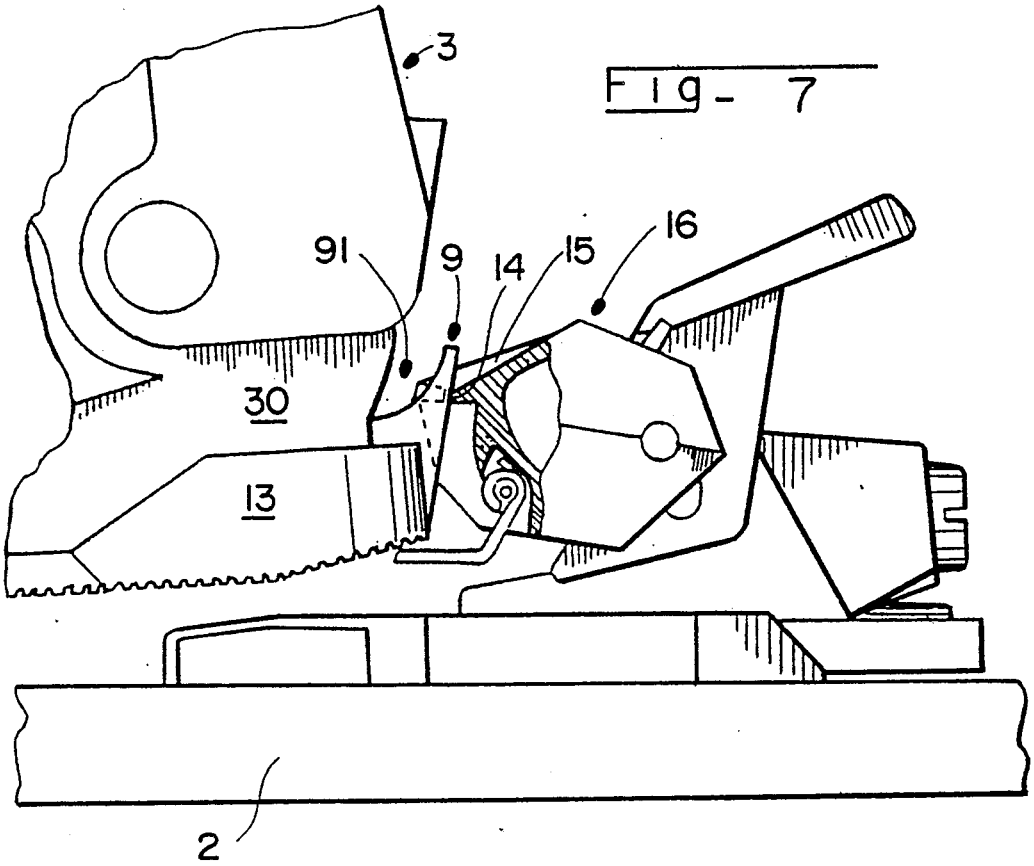
Fig- 7
Fig- 8
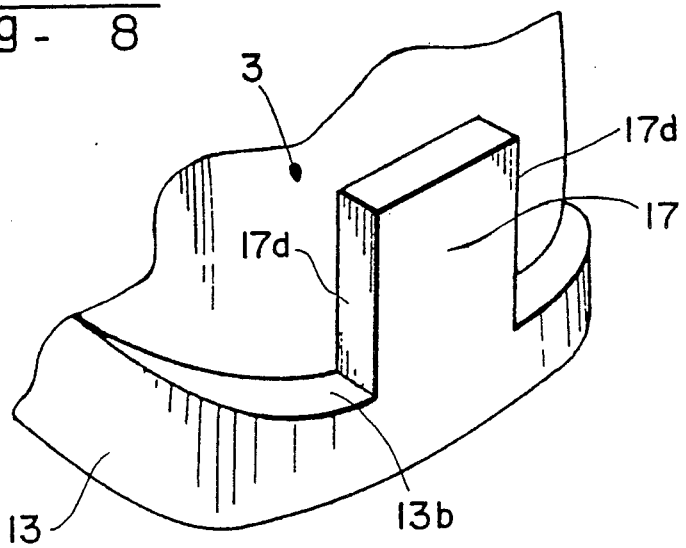

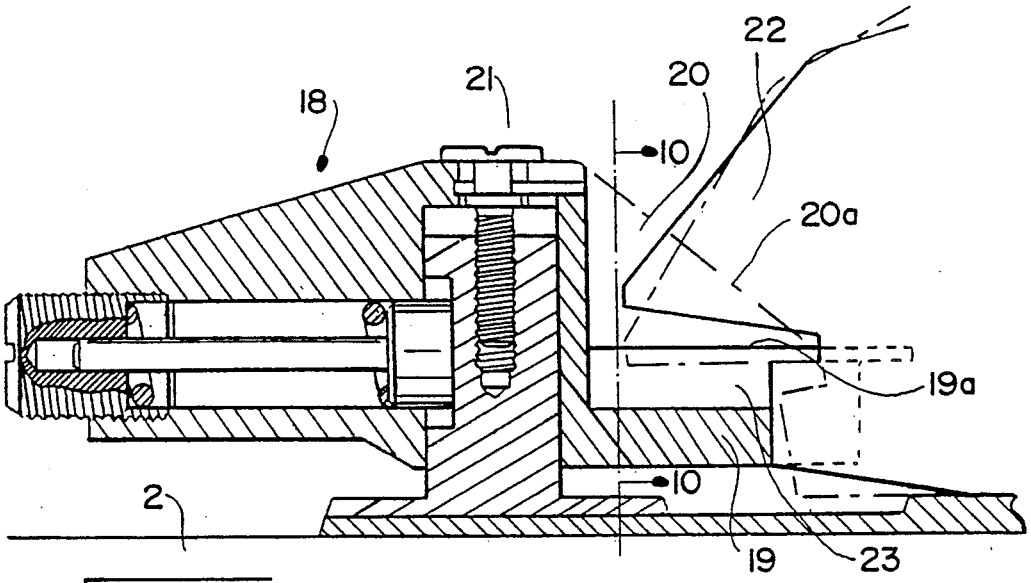
Fig. 9
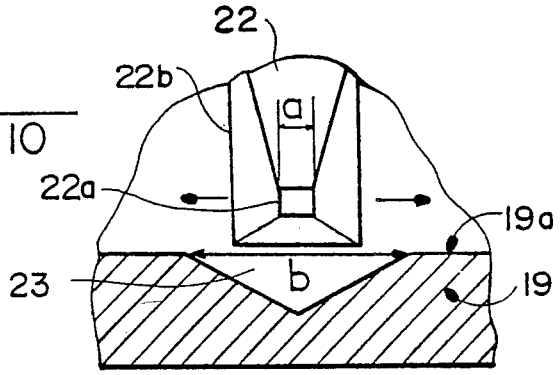
Fig. 10
Fig. 11
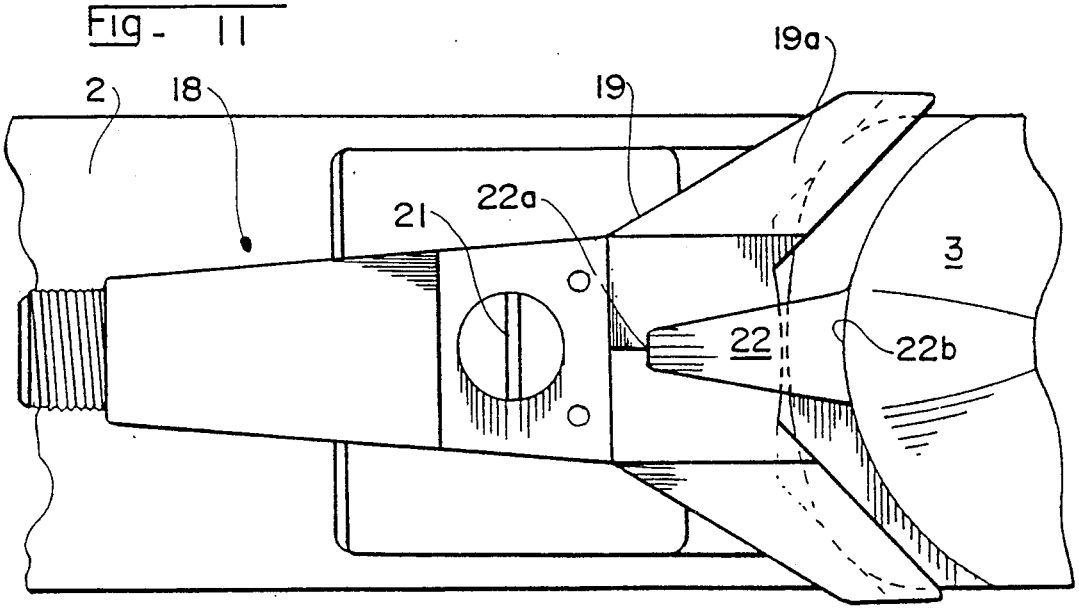

MODIFIED UNIVERSAL SKI BINDING FOR USE WITH DIFFERENT SKI BOOTS, AND BOOTS SPECIFIC TO CERTAIN BINDINGS

This is a continuation of application Ser. No. 690,882 filed Jan. 14, 1985 now issued U.S. Pat. No. 4,746,139.

BACKGROUND OF THE INVENTION

1. Field of the Invention

The present invention relates to ski boots which require specialized bindings, and to modified universal bindings capable of use with such types of boots, as well as others. The bindings are to be mounted on a ski such that they can bind any type of standardized boot, including those boots which require specialized bindings.

2. Description of Background

Ski boots are known whose vamps and uppers are formed in different ways but whose front and rear ends comprise zones which are standardized both as to their configuration and dimension. Present standards utilized for all ski boot manufacturers are those which have been developed by the German and Austrian Institutes of Standardization. The standards are known as ONORM and DIN, and the standards of each of the Institutes relative to the dimensions and configurations of boots to allow for their attachment on conventional bindings serve as the definition of what is meant by the terms "standard" and "standardized" as used in this application As of this time time the relevant standards are ONORM S4035 and S4036, and DIN standards 7880 parts 1 and 2, although it is understood that if these standards ever change or are supplanted by another series of standards, that it is the prevailing standards which are intended by this application. These norms call for standardized retention zones adapted to cooperate with corresponding zones of the binding to assure the maintenance and safe attachment of the boot on the ski, against bias exerted by the boot on the jaw of the binding, and to allow both for insertion of the boot into the binding and release of the boot from the binding when the force exerted on the boot exceeds a predetermined threshold.

These standardized retention and free or non-retention zones provided on the two ends of the boot, are constituted, for example, by a set thickness or height of the sole, a set width of the upper horizontal edge of the sole, a set height of the lower portion of the upper or the vamp which is positioned facing the binding, etc. These standardized retention zones are provided to allow for the use of boots of different types with a single type of safety binding or for the use of a given type of ski boot with different types of bindings.

Yet, it can be essential under certain circumstances to discriminate and distinguish boot types to provide for the dedicated use of a given type of ski boot with only one type of binding specially adapted for the boot. Such is the case, for example, if the boot is provided with an anti-skid sole made of rubber or similar material, so as to allow for walking. In this case, it becomes necessary to use only specialized bindings which comprise, for example, a moveable or pivotable plate which is interposed between the sole of the boot and the upper surface of the ski to minimize friction between the sole and the ski. If such a specialized binding is not utilized, the unwary skier may find that his foot is not released during a fall because of the additional frictional resistance exerted by the boot sole on the ski when release should normally occur. This may jam the boot and be very dangerous.

One can cite, for example, bindings of the type described in French Patent Applications 83 10989, 83 10819, and 83 19397 filed by Applicant, the disclosures of which are herein incorporated by reference. To avoid dangerous accidents, it becomes imperative to assure that when using a ski boot provided with an anti-skid sole, that it may be used with only a binding which is adapted specifically for this type of use such that the nature and actual form of the sole has no influence on the release of the boot. This might be done by using non-standardized boot zones which are capable of use with only specialized bindings.

However, while a non-standardized binding incapable of accepting standardized boots might well suit the desired function under such circumstances, this would, in effect, undesirably limit the use of the binding to only such specialized boots. It would be more desirable if the binding could be somewhat universal in nature, i.e., accept a plurality or even all types of boots, including specialized boots, provided that the boot comprises the standardized retention and free zones previously described.

SUMMARY OF THE INVENTION

It is the aim of the present invention to provide improvements to an assembly constituted by a safety binding and a ski boot wherein the boot can be used only with universal bindings which have been modified so as to permit use with the specialized boots.

It is a further object of the invention to provide boots which have otherwise standardized retention zones but which are modified to prevent use with conventional universal bindings which have not been specially modified so as to prevent utilization of the ski boot with a safety binding other than that with which it can be safely utilized.

It is yet another object of the invention to provide a modified universal binding capable of use with all boots having standardized retention and free or non-retention zones, as well as with boots which have specially modified zones which prevent their use other than with specially modified bindings.

The objectives of the invention are achieved by virtue of the ski boot according to the invention which comprises standard retention and free or non-retention zones at at least one of its ends to allow for the insertion of the boot into a binding adapted to secure a boot having standardized retention and free zones on at least one of its ends onto a ski. According to the invention the boot is prevented from being secured by the binding by blocking means on the boot.

As will be explained below, the term "standard" has a particular meaning and refers to the standards set by the appropriate agencies. For example, presently standardized retention and free zones conform to ONORM standard S4035 and S4036 and DIN standard 7880 standards 1 and 2.

The blocking means may be a projection positioned on the ski boot to project into the at least one retention and free zone of the binding to prevent the ski boot from being secured by the binding.

In one embodiment the blocking means is a projection mounted on the rear of the ski boot which prevents the rear portion of the binding from securing the heel of the ski boot. The blocking means may be a projection which extends rearwardly and upwardly from the rear portion of the boot. Alternatively, the blocking means may be a projection mounted on the front of the ski boot which prevents the front portion of the binding from securing the front of the ski boot.

The blocking means may be a projection molded onto the sole of the ski boot, or molded together with the sole of the ski boot. Alternatively, the blocking means is a projection secured onto the ski boot by attachment means such as screws.

The projection may have a variety of configurations, e.g., a generally rectangular configuration; a triangular projection having its base on the boot with one apex of the triangle projecting into the binding to prevent insertion of the boot; or a projection having its base secured onto the boot with a generally semi-circular surface projecting towards the binding to prevent insertion of the boot.

A space may be provided between the rear lower portion of the upper and the projection to allow for the rearward pivoting of at least a portion of the upper, e.g., the rear spoiler.

The boot itself may have a sole with an anti-skid surface which would normally be dangerous to the user if the boot were secured onto a ski by means of a ski binding requiring the boot to pivot directly on the ski during release of the boot.

The invention also relates to what is characterized in this application as a "modified universal ski binding" for attachment of a ski boot onto a ski. The modified universal binding may comprise, for example, a jaw having a median portion having a cut-away portion adapted to receive a projection positioned at a corresponding position on the boot which prevents the boot from insertion into standardized bindings suited to bind ski boots having standardized retention and free zones. In this way, the binding is capable of accepting boots, whether or not they have projections thereon. As noted above, the standardized retention and free zones conform to ONORM standard S4035 and S4036 and DIN standard 7880 parts 1 and 2.

The cut-away portion forms a receptor seat for the projection. The receptor seat may have a variety of configurations, e.g., a generally rectangular configuration; a curved configuration; or a triangular configuration.

The seat may be provided either at the front and/or rear portion of the binding to match with the corresponding projection.

The modified universal binding may in one embodiment be one further comprising a pivotable plate which is pivotable to facilitate release of boots having an anti-slip sole.

More generally, the invention relates to the combination of a modified universal binding adapted to be mounted on a ski, and a ski boot. The modified universal binding comprises, for example, at least one jaw for securing the boot to the ski. The boot comprises at each of its ends a standardized retention and free zone adapted to cooperate with at least one corresponding zone on the jaw of the binding to allow for the insertion of the boot and the safe maintenance of the boot on the ski. At least one of the ends of the boot comprises a blocking means adapted to engage a corresponding portion provided on the jaw of the binding in a manner so as to allow for the utilization of the boot only with modified bindings having standardized retention and free zones adapted whereby the blocking means does not interfere with insertion of the boot into the binding.

The blocking means prevents insertion of a boot having at least one standardized retention and free zone into an otherwise unmodified binding having standardized retention and free zones. The modified universal binding is adapted for use with boots having the standardized retention and free zones whether or not they comprise the blocking means.

The portion on the binding corresponding to the projection comprises a cut-away portion having a receptor seat therein which may have a configuration which is substantially complementary to the configuration of the blocking means.

The blocking means may be a projection comprising two lateral retention surfaces adapted to cooperate with corresponding surfaces provided within the receptor seat. The cooperation between the retention surfaces of the projection and the corresponding surfaces of the seat assures lateral retention of the boot on the ski. In this embodiment, the width of the projection in the horizontal direction defined as the distance between the retention surfaces substantially corresponds to that of the receptor seat in which it is to be tightly retained, whereby the projection contributes to the lateral retention of the ski boot.

Alternatively, the blocking means may be a projection freely engaged in the opening with a lateral play whereby the projection does not substantially contribute to lateral retention of the boot.

Rather than using a receptor seat whose perimeter is completely defined, the receptor seat may be constituted by a free space provided above the jaw of the binding. The free space may be on the upper horizontal surface of the jaw and have a width greater than the width of the projection whereby the boot is not laterally secured within the modified universal binding by means of the projection.

The free space may be bounded on the bottom by a surface having a recess therein to permit the projection to pivot downwardly in response to a frontward fall.

BRIEF DESCRIPTION OF THE DRAWINGS

The invention will now be described with reference to certain non-limiting examples of various embodiments of the present invention with reference to the annexed drawings in which:

FIG. 7 is a side elevational view of the rear portion of a ski boot cooperating with a rear binding mounted directly on the ski, with partial cross section of the jaw;

FIG. 8 is a rear perspective view of the rear portion of the boot having an alternative embodiment of the projection;

FIG. 9 is a longitudinal and vertical cross sectional view of a front binding with which the ski boot having a projection at its front end cooperates;

FIG. 10 is a vertical and transverse cross sectional view along line X—X of FIG. 9;

FIG. 11 is a top planar view of the front abutment and of the front portion of the boot shown in FIG. 9;

FIGS. 12 and 13 illustrate an alternative embodiment wherein:

FIG. 12 is a view similar to that of FIG. 3, while FIG. 13 is a view similar to that of FIG. 8;

FIGS. 14 and 15 illustrate another alternative embodiment wherein:

FIG. 14 is a view similar to FIG. 3 while FIG. 15 is a view similar to that of FIG. 8;

DESCRIPTION OF PREFERRED EMBODIMENTS

Figure 1:
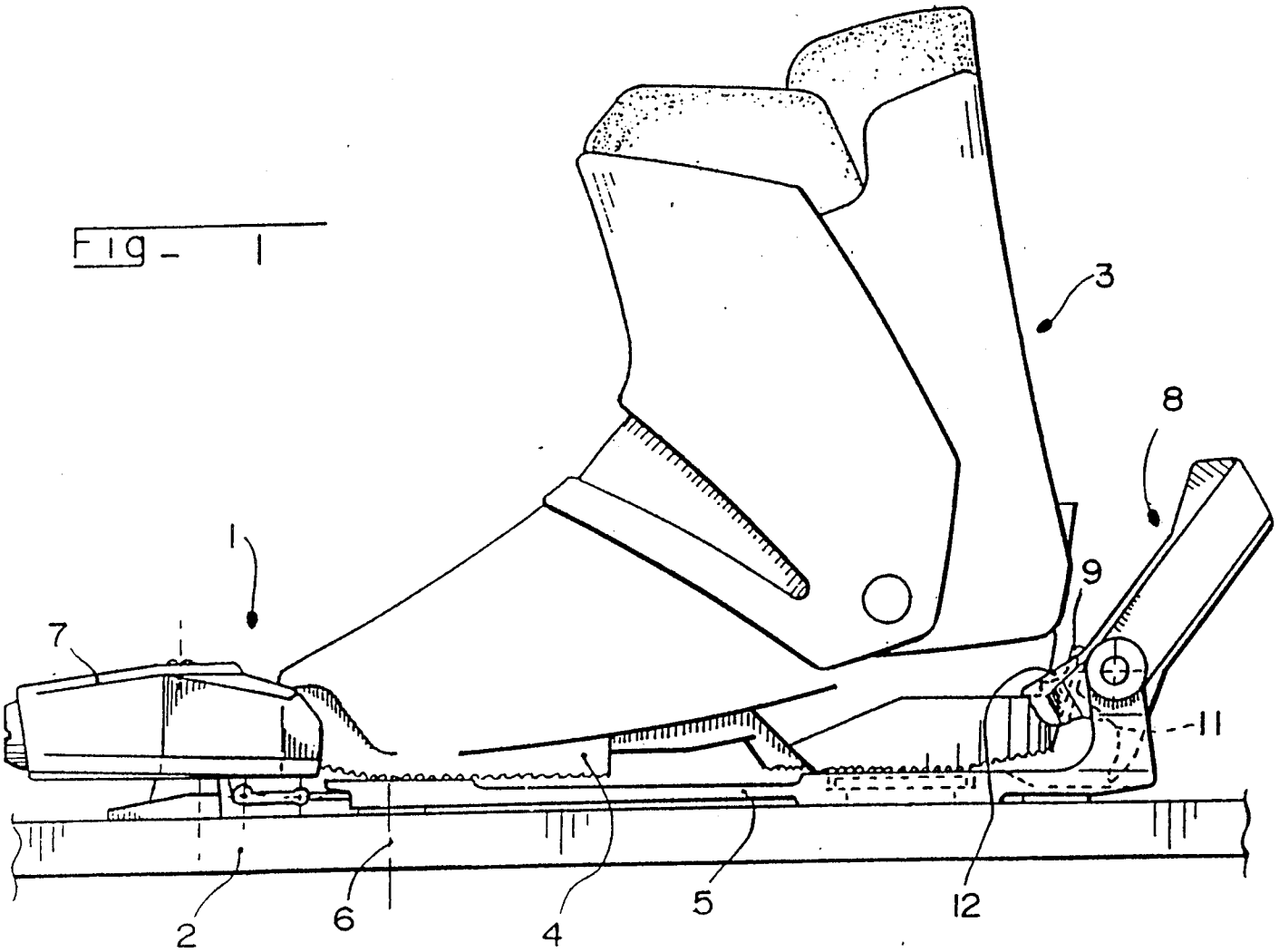
FIG. 1 is a side elevational view of an assembly constituted by the safety binding of the pivotable-plate type, and a ski boot provided with a projection at the rear end of the sole.
Figure 2:
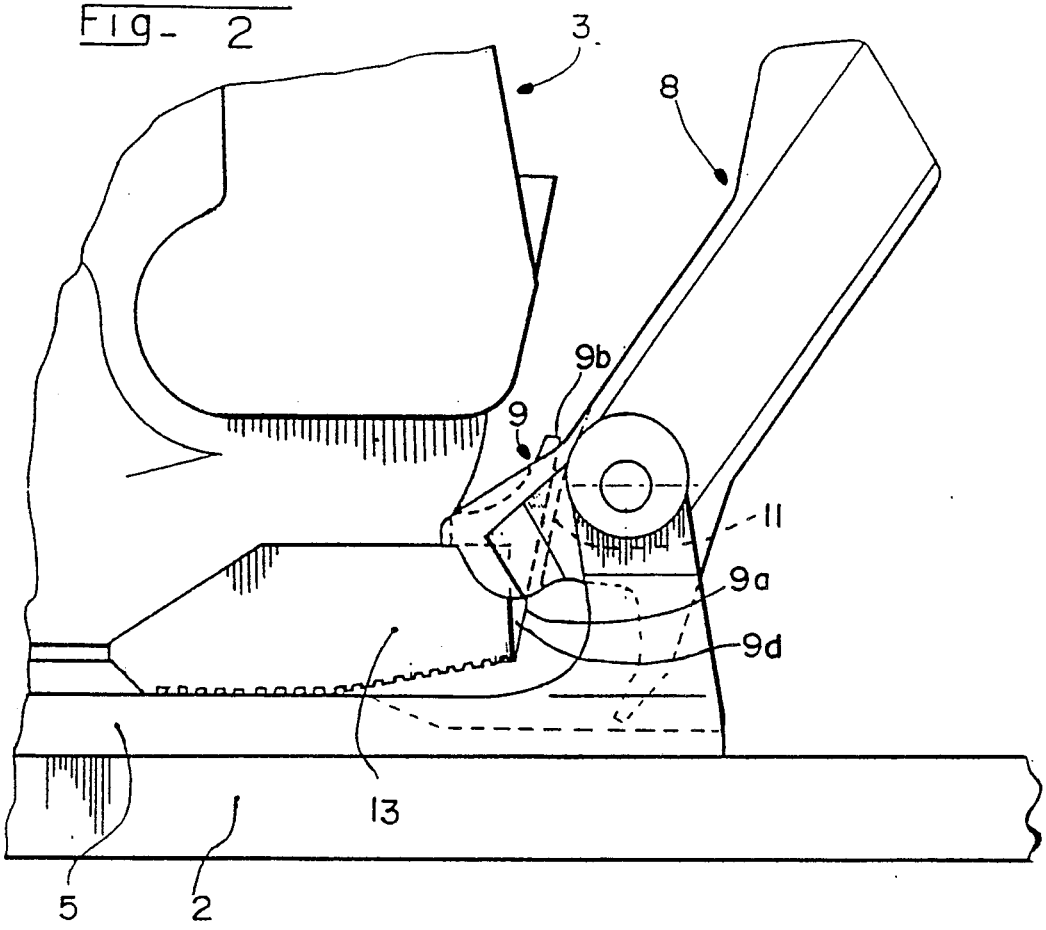
FIG. 2 is a partial elevational view, on a larger scale, of the rear portion of the boot and of the rear binding, with the boot in the inserted position.

To achieve the objectives set forth above, the assembly is constituted by a safety binding mounted on a ski in combination with a ski boot. The boot comprises at its ends zones of retention and disengagement which are standardized and which are adapted to cooperate with corresponding zones on the jaw of the binding to allow for the insertion of the boot and the safe maintenance of the boot on the ski. At least one of the ends of the boot comprises a portion which projects with respect to the standardized zones and is adapted to engage in a corresponding cut-away portion provided on the jaw of the binding in a manner such as to allow for the utilization of the boot with its projection only with a binding which has been specifically modified to have a cut-away portion, while the binding allows for the utilization and the retention of all boots having the standardized zones with or without the projection.

The projection of the boot can be formed by molding onto the sole, or furthermore it can be molded therewith or can be constituted by an element which is added thereto so as to assure that a projection exists.

The projection may or may not contribute to the retention of the boot on the ski. In the first case, the width of the projection, i.e., its extension in the transverse direction, corresponds to that of a receptor seat in which it is tightly retained. In the second case the projection is freely engaged in the seat with a lateral play such that the seat does not contribute to the lateral retention of the boot. In either case the boot is adapted whereby portions other than the projection contribute to release during a fall.

FIGS. 1–5 illustrate an assembly according to the invention which comprises a safety binding 1 mounted on a ski 2 and, on the other hand, a ski boot 3. The boot comprises in the normal manner, at its front and rear ends, standardized retention zones which cooperate with corresponding zones on the binding to assure the safe maintenance of the boot 3 on the ski. More particularly, in the non-limiting example illustrated in the drawing, boot 3 is of the type which comprises a sole 4 which is anti-slip and is made out of rubber or similar material. Such a boot must be utilized with a binding 1 which is specially adapted to this type of boot. Binding 1 is of the type having an interposed plate 5 which is interposed between sole 4 and the upper surface of the ski 2. Plate 5 pivots around an axis 6 which is perpendicular to the upper planar surface of ski 2. Boot 3 is held in front by a front abutment 7 which is integral with ski 2, and, at the rear, by a rear binding 8 which, in the embodiment shown is itself, integral with the rear portion of pivotal plate 5.

So as to prevent ski boot 3 which is provided with an anti-slip sole 4 from being utilized with bindings of a conventional nature which are not specifically adapted to secure such a boot and which would pose a dangerous situation for the skier by virtue of the particular anti-slip sole 4, a projection 9 is provided at one of the ends, e.g., the rear end 3 in the embodiment shown.

Projection 9 is adapted to engage in a receptor seat 11 provided in the central portion of rear jaw 12 of rear binding 8. Seat 11 opens to the front and has in horizontal cross section, a U-shape which is frontwardly directed. Projection 9 can be molded onto or be directly molded with the rear median portion of heel 13 of boot 3. More particularly with reference to FIG. 5, projection 9 may comprise, in a non-limiting embodiment, a rear transverse surface 9*a* which inclines from bottom to top towards the rear, beginning at the median portion of the lower edge of heel 13, an upper edge 9*b* which is relatively thin, an interior curved surface 9*c* running from upper edge 9*b* to the lower portion of the vamp of the boot, and two lateral vertical and longitudinal surfaces 9*d* beginning at the rear portion 13*a* of heel 13 and the upper edge 13*b* of the heel.

Projection 9 may or may not contribute to the lateral retention of ski boot 3 on ski 2. In the non-limiting example illustrated in FIGS. 1–5, projection 9 effectively contributes to this retention and to this end its width "a" (FIG. 3) i.e., its dimension in the horizontal transverse direction, or the distance between two lateral vertical surfaces 9*d*, is equal to the width of the receptor seat 11 provided in jaw 12 of heel binding 8, i.e., the distance between the two lateral internal surfaces 11*a* defining the seat 11. As a result, the two lateral and vertical surfaces 9*d* of projection 9 are engaged and in tight contact with the two internal vertical and longitudinal surfaces 11*a* defining seat 11. This cooperation assures a lateral retention at the location of the heel and the shocks are directly registered by this projection which assures greater safety while diminishing the risk of premature release.

It is seen, from the description above, that ski boot 3, provided at its rear end with projection 9, can be utilized only with a binding 1 whose rear binding 8 has been adapted so as to have, in its rear jaw 12, a receptor seat 11 for projection 9.

Even though projection 9 is preferably formed by being molded onto or molded directly with heel 13, it can likewise be constituted by an element which is otherwise secured onto the heel, i.e., by screws.

FIG. 7 illustrates a ski boot according to the invention, i.e., with a projection 9, in the course of an attempt to insert the boot into a traditional binding 16, i.e., a binding not having a receptor seat. It is seen, that under these conditions, insertion of the boot is not possible. In effect, the front median portion 14 of jaw 15 hits projection 9 and insertion of the boot is prevented, which of course prevents skiing from occurring.

Figure 6:
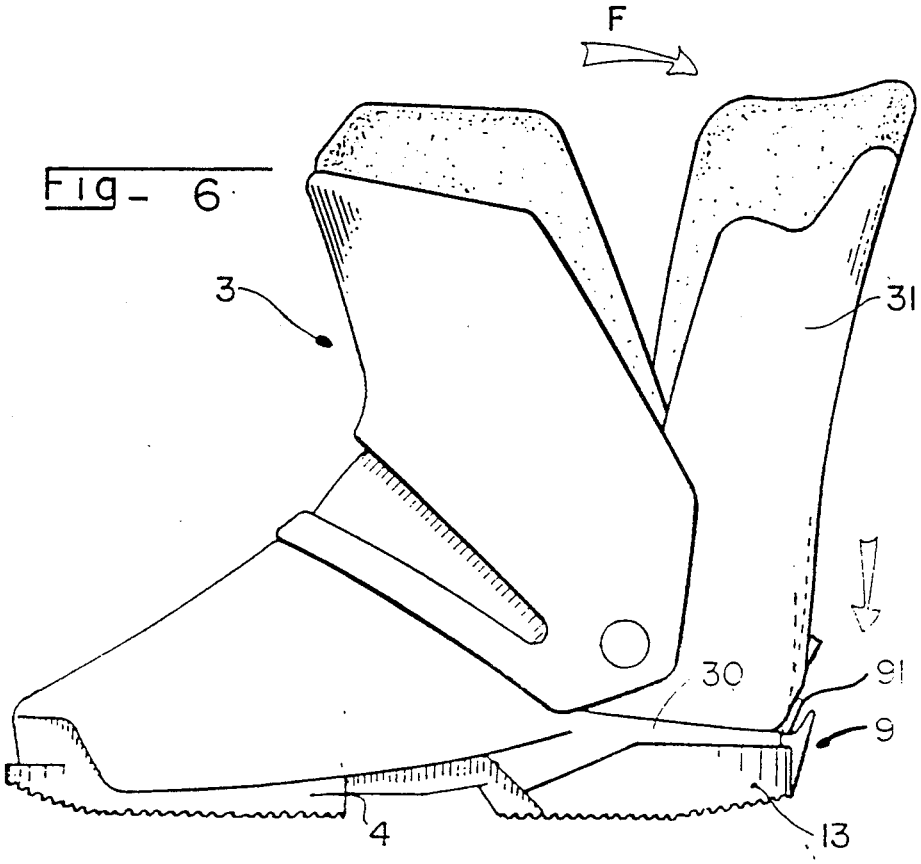
FIG. 6 is a side elevational view of the ski boot separated from the safety binding having a pivotable plate.
Figure 5:
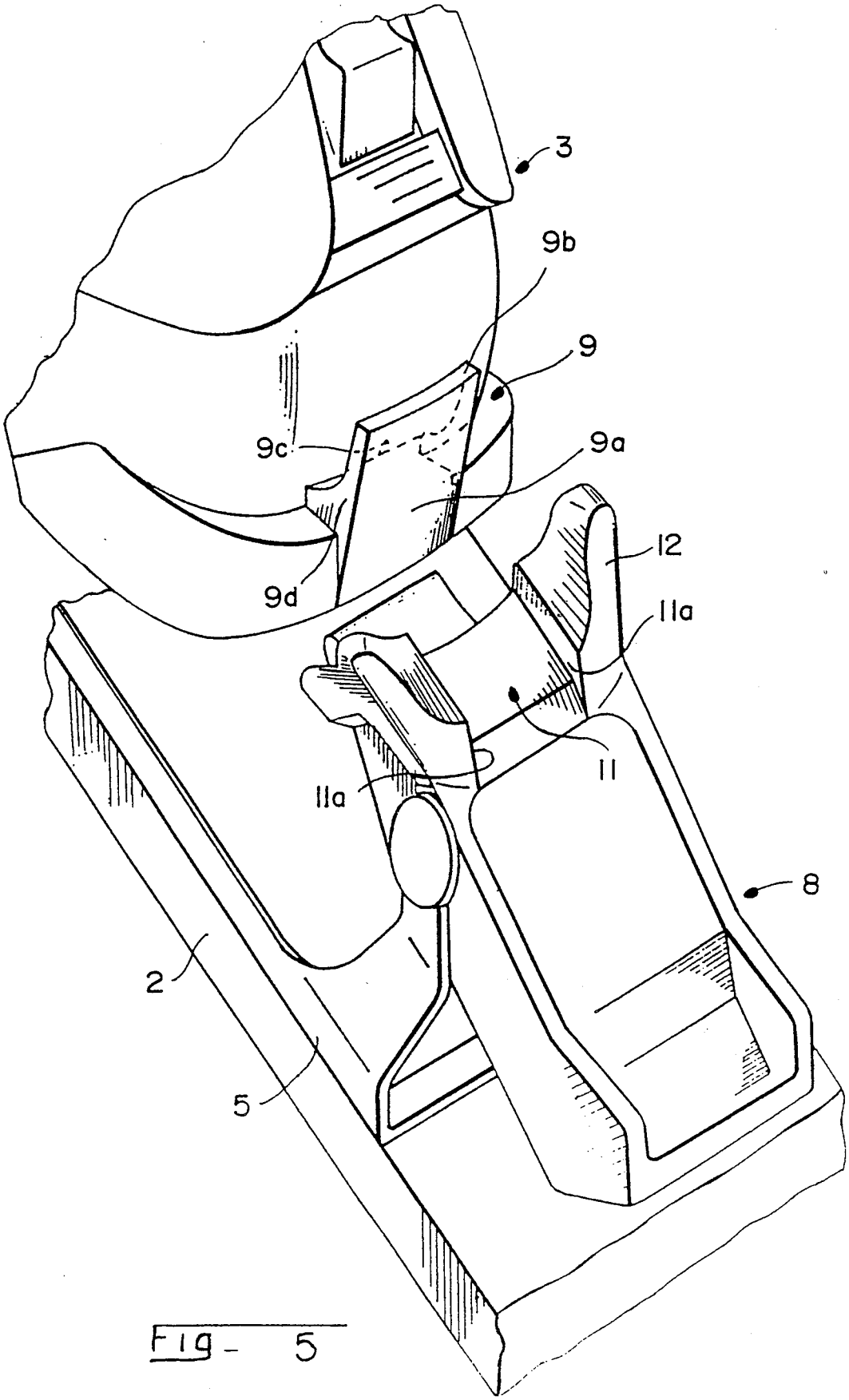
FIG. 5 is a rear perspective view of the rear portion of the boot and of the rear binding in the set position ready for insertion of the boot.

In FIGS. 1–7 projection 9 is spaced from the shell base so as to create a seat 91 allowing for the passage of the lower portion of the rear spoiler 31 during its rearward pivoting along the direction of arrow F (FIG. 6).

Projection 9 can assume various geometric configurations different from those illustrated in FIGS. 1–7. For example, as is shown in FIG. 8, projection 17 can have a parallelopipedic configuration which extends upwardly from the upper horizontal edge 13*b* of heel 13.

Referring now to FIGS. 9–11, an alternative embodiment is described in which ski boot 3 is retained on the ski, at its front end by a front abutment 18 which comprises a retention jaw 19 which can pivot around a vertical axis 21. Front abutment 18 comprises an elastic return mechanism for returning jaw 19 into a median engagement position which is that illustrated in the drawing.

To allow for the cooperation of ski boot 3 with only a single type of binding, the boot is provided at its front end with a projection 22 which extends into space 20 constituted by a free space provided above jaw 19. This space is obtained by eliminating, in a conventional retention jaw, the upper portion included between the posterior surface, inclined from top to bottom towards the rear of the jaw, this surface being indicated by dashed lines 20*a*. Horizontal plane 19*a* constitutes the upper surface of jaw 19 which is "amputated" when compared with a conventional jaw. Jaw 19 furthermore has a space 23 provided in the upper median portion which opens onto upper surface 19*a*. More particularly, space 23 can have a V or U cross section of a width "b" greater than the width "a" of projection 22. In this case projection 22 does not contribute to the lateral retention of the boot, a retention which is assured only by the cooperation of the standardized retention zones of the sole with the corresponding zones of jaw 19.

In the non-limiting embodiment shown in FIG. 11, projection 22 has substantially the form of an irregular truncated pyramid situated above opening 23, the truncated pyramid having, in front, a minor base 22*a* of width "a" connected, at its major base 22*b*, to the front portion of the upper of boot 3. This allows for a normal lateral release with projection 22 moving freely along the transverse direction of the arrows in FIG. 10, above the upper horizontal surface 19*a* of jaw 19.

Space 23 allows for a pivoting, in the opening, of front projection 22, in the event of a frontward fall, or during insertion to assure the normal operation of the rear binding so as to retain the rear portion of the boot.

Alternative embodiments of projections are shown in FIGS. 12–15.

Figure 3:
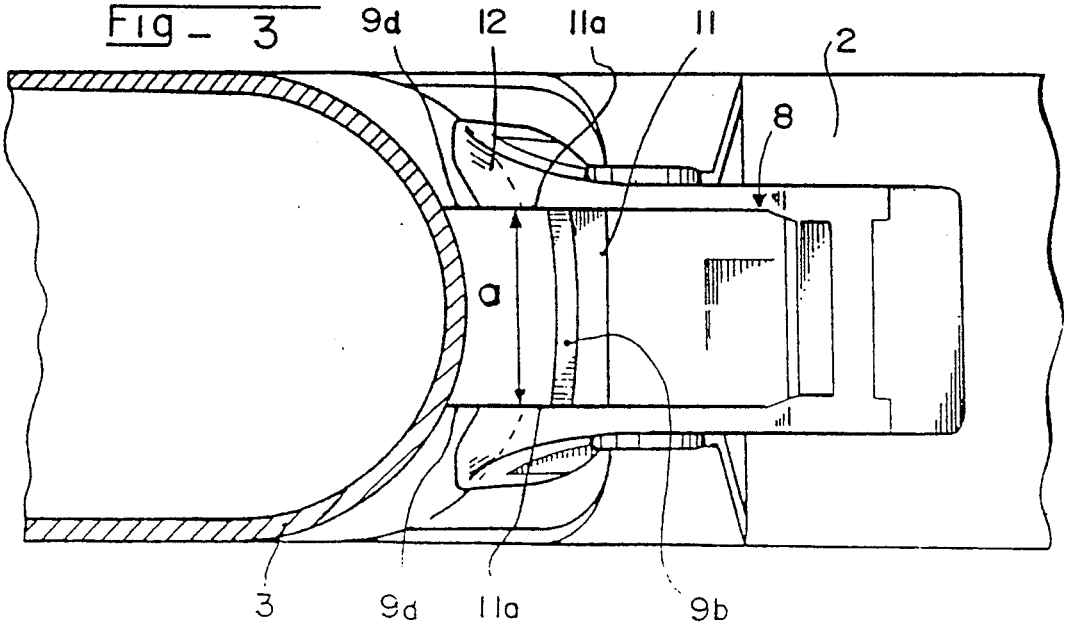
FIG. 3 is a top planar view of the rear binding of FIG. 2 with the rear portion of the ski boot in horizontal cross-section, the boot being in the inserted position.
Figure 4:
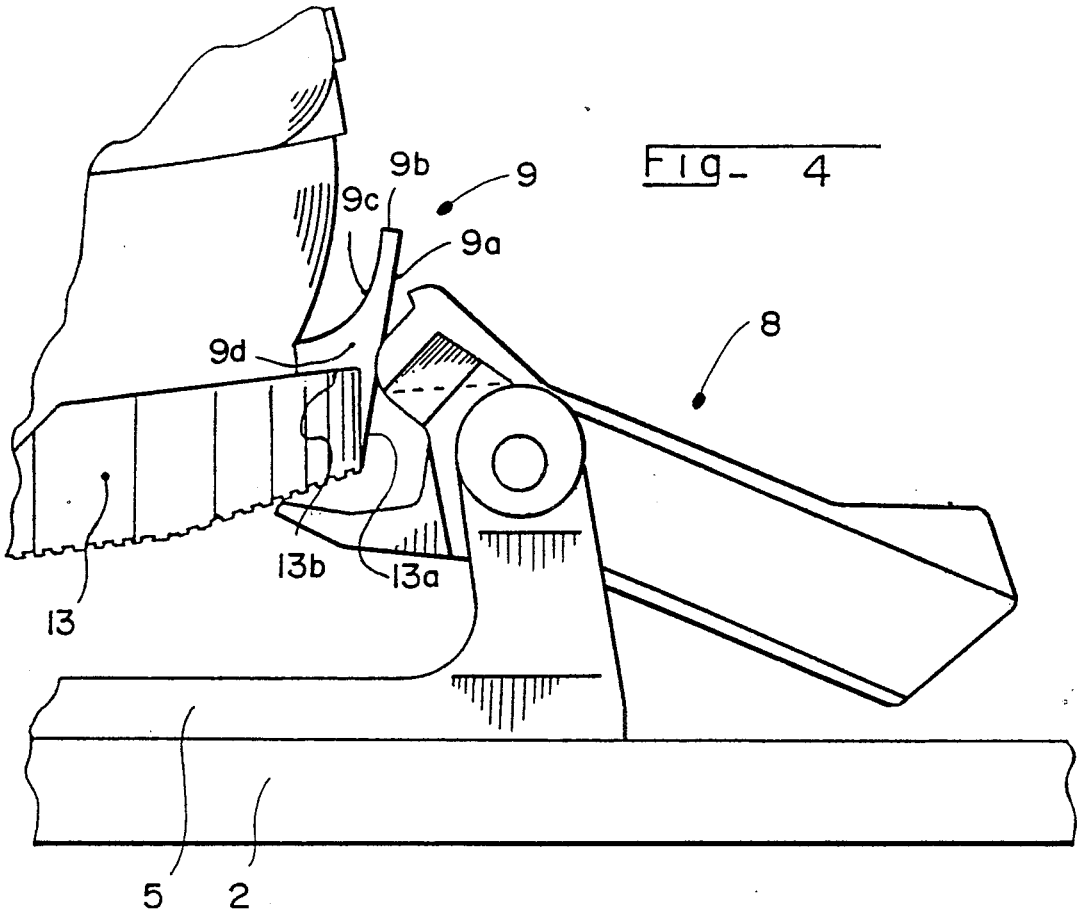
FIG. 4 is an elevational view of the rear binding with the boot in the raised position during insertion into the rear portion of the boot.
Figure 12:
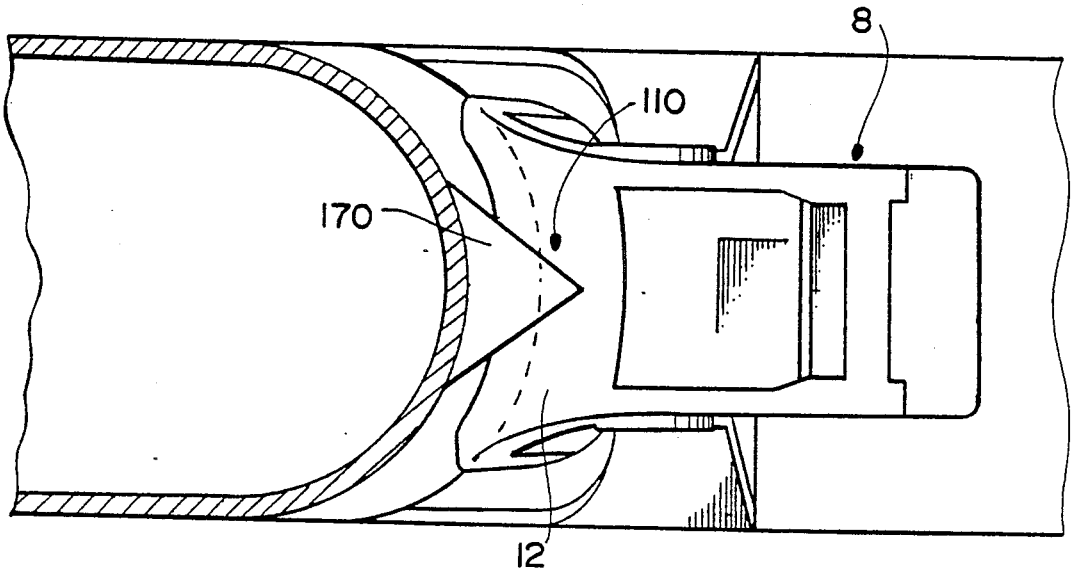
Figure 13:
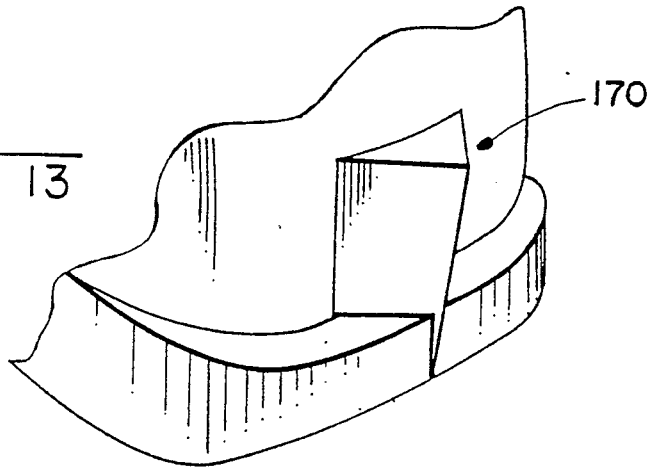

FIGS. 12 and 13 are similar to FIGS. 3 and 8 and illustrate an alternative embodiment in which projection 170 is provided at the rear of the boot in the form of a triangular projection which is pointed and which is directed towards the rear and cooperates with a seat 110 of complementary configuration, i.e., having a V shape which is open towards the front, provided in the median portion of jaw 12 of rear binding 8.

Figure 14:
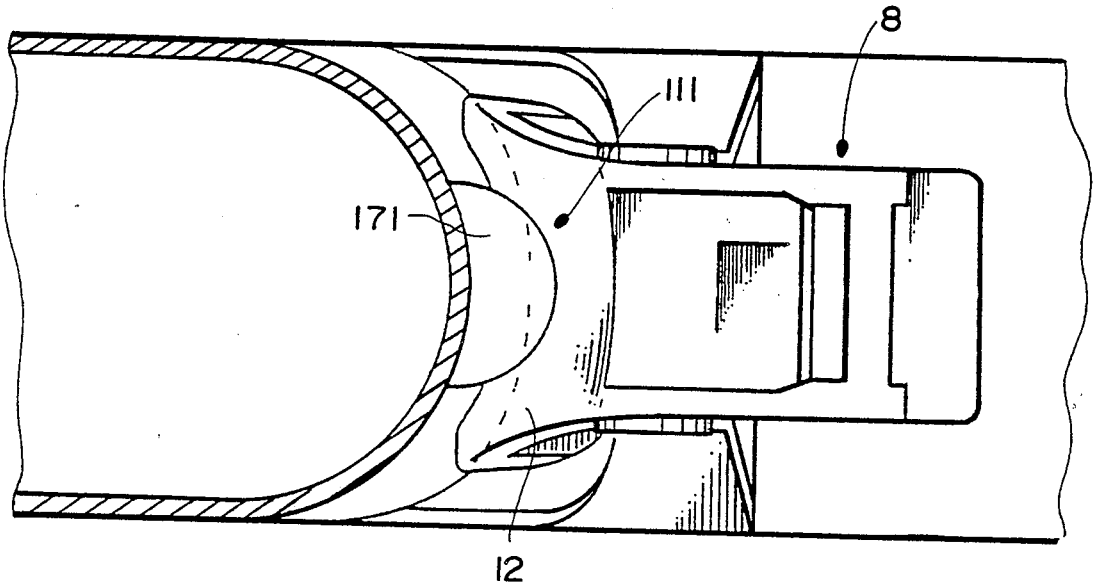
Figure 15:
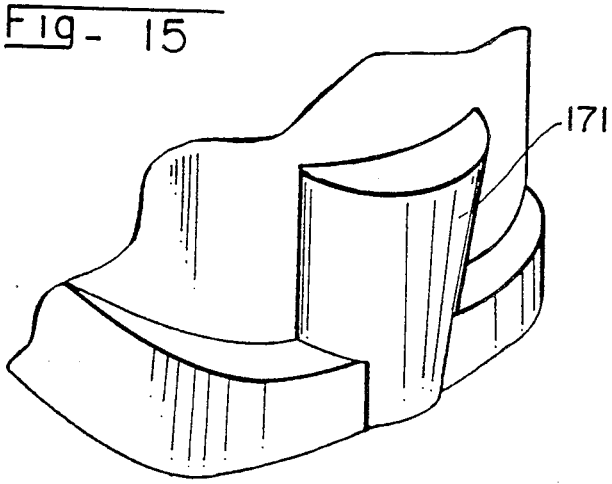

FIGS. 14 and 15 illustrate another embodiment in which projection 171 has a curved or semi-circular profile, with a rearwardly directed convexity extending upwardly and which cooperates, with the boot, in the inserted position, with a seat 111 of complementary curved configuration, i.e., having a frontwardly directed concavity, provided in the median portion of jaw 12 of rear binding 8.

Figure 16:
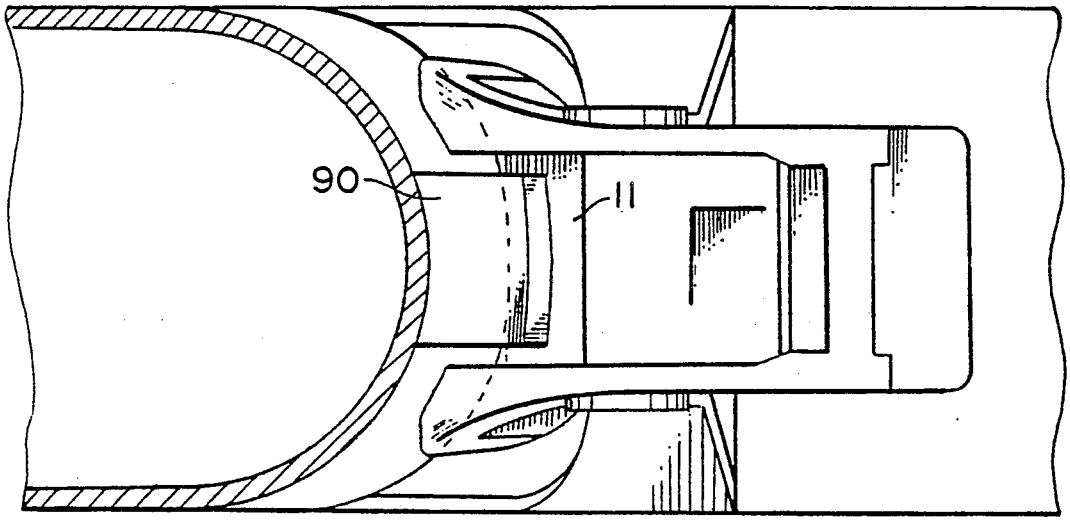
FIG. 16 is a view similar to FIG. 3 illustrating yet another embodiment.

FIG. 16 illustrates an alternative embodiment in which receptor seat 11 is wider than corresponding projection 90 which is provided in the rear portion of the boot such that projection 90 does not contribute to lateral retention.

Figure 17:
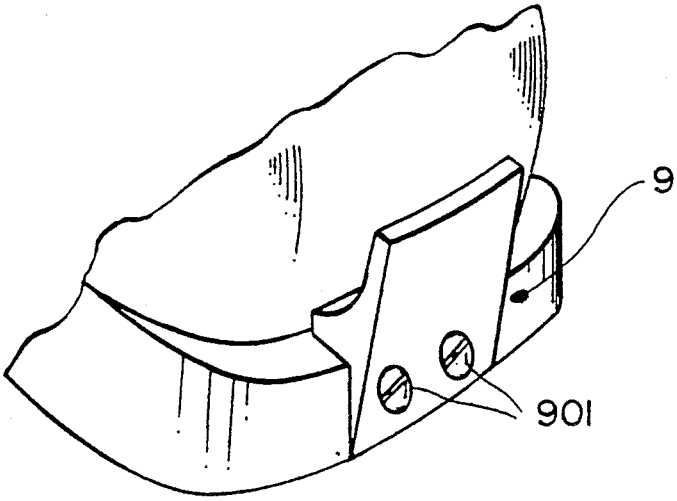
FIG. 17 is a perspective view illustrating another alternative embodiment of the invention.

FIG. 17 illustrates an alternative embodiment in which projection 9 is a separate element secured onto the heel by two screws 901.

Figure 18:
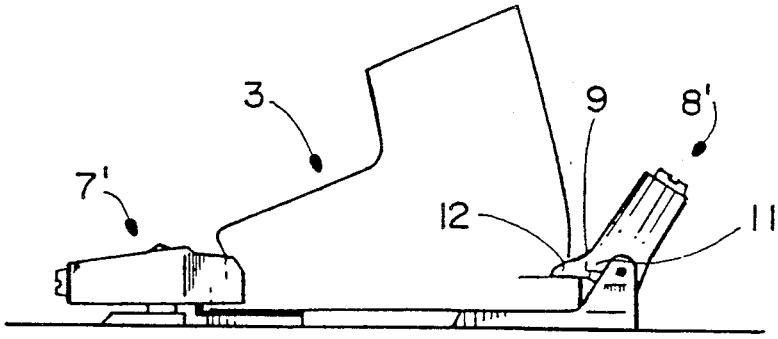
FIG. 18 is another embodiment illustrated schematically.

FIG. 18 illustrates another assembly according to the invention. In this embodiment boot 3 is a boot similar, for example, to that shown in FIGS. 1–6 which comprises a projection 9 positioned in the rear portion of the boot which is retained by a binding 8′ whose jaw 12 comprises a receptor seat 11. The front portion of the boot is, itself, retained on the ski by a binding 7′ of the type described in French Patent Applications 82 2057 or 80 00863, the disclosures of which are herein incorporated by reference.

It will be noted that the boot according to the invention can be utilized only with universal bindings modified according to the invention. However, the binding itself can be utilized with any type of conventional boot on the condition that it comprises at least the standardized zones.

Of course, the invention relates as well to the boot itself, as well as to the binding for it; to the combination of the boot plus the binding; and even a ski equipped with such a combination.

Finally, although the invention has been described with respect to particular means, materials and embodiments, it should be understood that the invention is not limited to the particulars disclosed and extends to all equivalents within the scope of the claims.

What is claimed is:

1. A ski boot comprising standard retention and free zones at at least one of its ends to allow for the insertion of the boot into a binding adapted to secure a boot having standardized retention and free zones on at least one of its ends onto a ski, wherein said boot further comprises blocking means for preventing said boot from being secured to said binding by said blocking means, wherein said blocking means prevents said boot from being secured in bindings lacking means for receiving said blocking means, wherein said boot includes means in addition to said blocking means for laterally retaining said boot in said binding which includes standardized retention and free zones and which includes means for receiving said blocking means, and wherein said blocking means is a projection molded onto the sole of said boot.

2. The ski boot as defined by claim 1 wherein said blocking means is a projection positioned on said boot to project into said at least one retention and free zones of said binding to prevent said boot from being secured by said binding.

3. The ski boot as defined by claim 1 wherein said standardized retention and free zones conform to ONORM standard S4035 and S4036.

4. The ski boot as defined by claim 1 wherein said standardized retention and free zones conform to DIN standards 7880 parts 1 and 2.

5. The ski boot as defined by claim 1 wherein said blocking means is a projection mounted on the rear of said boot which prevents the rear portion of said binding from securing the heel of said boot.

6. The ski boot as defined by claim 1 wherein said blocking means is a projection mounted on the front of said boot which prevents the front portion of said binding from securing the front of said boot.

7. A ski boot comprising standard retention and free zones at at least one of its ends to allow for the insertion of the boot into a binding adapted to secure a boot having standardized retention and free zones on at least one of its ends onto a ski, wherein said boot further comprises blocking means for preventing said boot from being secured to said binding by said blocking means, wherein said blocking means prevents said boot from being secured in bindings lacking means for receiving said blocking means, wherein said boot includes means in addition to said blocking means for laterally retaining said boot in said binding which includes standardized retention and free zones and which includes means for receiving said blocking means, and wherein said blocking means is a projection molded together with the sole of said boot.

8. A ski boot comprising standard retention and free zones at at least one of its ends to allow for the insertion of the boot into a binding adapted to secure a boot having standardized retention and free zones on at least one of its ends onto a ski, wherein said boot further comprises blocking means for preventing said boot from being secured to said binding by said blocking means, wherein said blocking means prevents said boot from being secured in bindings lacking means for receiving said blocking means, wherein said boot includes means in addition to said blocking means for laterally retaining said boot in said binding which includes standardized retention and free zones and which includes means for receiving said blocking means, wherein said blocking means is a projection extending rearwardly and upwardly from the rear portion of said boot, and wherein said projection has a generally rectangular configuration.

9. The ski boot as defined by claim 8 wherein said blocking means is a projection secured onto said boot by attachment means.

10. The ski boot as defined by claim 9 wherein said attachment means are screws.

11. The ski boot as defined by claim 1 wherein said blocking means is a triangular projection having its base on said boot with one apex of said triangular projection projecting into said binding to prevent insertion of said boot.

12. The ski boot as defined by claim 1 wherein said blocking means is a projection having its base secured onto said boot and has a generally semi-circular surface projecting towards said binding to prevent insertion of said boot.

13. The ski boot as defined by claim 1 having a sole with an anti-skid surface which would normally be dangerous to the user if said boot were secured onto a ski by means of a ski binding requiring said boot to pivot directly on said ski during release of said boot.

14. The boot defined by claim 1 further comprising means for engaging lateral retention means on said binding without engaging said blocking means with said lateral retention means.

15. The combination defined by claim 14 wherein said standardized retention and free zones conform to ONORM and/or DIN standards.

16. A modified universal ski binding for attachment of a ski boot onto a ski, said modified universal binding comprising a jaw having a median portion, said median portion having a cut-away portion adapted to receive a projection positioned at a corresponding position on said boot which prevents said boot from insertion into standardized bindings suited to bind ski boots having standardized retention and release zones, wherein said jaw comprises means for holding boots having said standardized retention and release zones without said projection and with said projection, wherein said jaw comprises means for retaining boots having said projection thereon without vertically retaining said projection, said binding comprising a front jaw and a rear jaw for securing the front and rear ends of said boot, respectively, said modified universal binding further comprising a pivotable plate, said pivotable plate being pivotable to facilitate release of boots having an anti-slip sole.

17. The modified universal ski binding as defined by claim 16 wherein said standardized retention and free zones conform to ONORM standards S4035 and S4036.

18. The modified universal ski binding as defined by claim 16 wherein said standardized retention and free zones conform to DIN standards 7880 parts 1 and 2.

19. The modified universal ski binding as defined by claim 16 wherein said cut-away portion forms a receptor seat for said projection.

20. A modified universal ski binding for attachment of a ski boot onto a ski, said modified universal binding comprising a jaw having a median portion, said median portion having a cut-away portion forming a receptor seat for receiving a projection positioned at a corresponding position on said boot which prevents said boot from insertion into standardized bindings suited to bind ski boots having standardized retention and release zones, wherein said jaw comprises means for holding boots having said standardized retention and release zones without said projection and with said projection, wherein said jaw comprises means for retaining boots having said projection thereon without vertically retaining said projection wherein said receptor seat has a generally rectangular configuration.

21. The modified universal ski binding as defined by claim 19 wherein said receptor seat has a curved configuration.

22. The modified universal ski binding as defined by claim 19 wherein said receptor seat has a triangular configuration.

23. The modified universal ski binding as defined by claim 16 adapted to retain the rear-end of said boot having said projection at the rear end thereof.

24. In combination a modified universal binding adapted to be mounted on a ski, said modified universal binding comprising at least one jaw for securing said boot to said ski and a ski boot comprising at each of its ends at least one standardized retention and release zone comprising means for engaging at least one corresponding standardized retention and release zone on said jaw of said binding to allow for the insertion of said boot and the safe maintenance of said boot on said ski, wherein at least one of the ends of said boot comprises a blocking means adapted to engage a corresponding portion provided on said jaw of said binding in a manner so as to allow for the utilization of said boot only with modified bindings having standardized retention and release zones adapted whereby the blocking means does not interfere with insertion of said boot, wherein said corresponding portion comprises a cut-away portion having a receptor seat therein which has a configuration which is substantially complementary to the configuration of said blocking means, wherein said blocking means is a projection comprising two lateral retention surfaces adapted to cooperate with corresponding surfaces provided within said receptor seat, the cooperation between the retention surfaces of the projection and the corresponding surfaces of the seat thereby ensuring lateral retention of the boot on said ski, wherein the width of said projection in the horizontal direction defined as the distance between said retention surfaces substantially corresponds to that of the receptor seat in which it is to be tightly retained, whereby said projection contributes to the lateral retention of said boot.

25. The combination as defined by claim 24 wherein said blocking means is a projection which projects into said modified universal binding.

26. The combination as defined by claim 24 wherein said blocking means prevents insertion of said boot having said at least one standardized retention and free zone into an otherwise unmodified binding having standardized retention and free zones.

27. The combination as defined by claim 24 wherein said modified universal binding is adapted for use with boots having said standardized retention and free zones whether or not they comprise said blocking means.

28. The combination as defined by claim 24 wherein said blocking means is a projection freely engaged in said corresponding portion with a lateral play whereby said projection does not substantially contribute to lateral retention of said boot.

29. The combination as defined by claim 24 wherein said blocking means is a projection provided at the front end of said boot and is adapted to extend into a receptor seat constituted by a free space provided on said jaw of said binding.

30. The combination as defined by claim 29 wherein said free space on said jaw has a width greater than the width of said projection whereby said boot is not laterally secured within said modified universal binding by means of said projection.

31. The combination as defined by claim 30 wherein said free space is bounded on the bottom by a surface having a recess therein to permit said projection to pivot downwardly in response to a frontward fall.

32. The combination as defined by claim 24 wherein said blocking means is a projection having the form of an irregular truncated pyramid having a minor base in front connected by means of its major base to a front portion of the upper of said boot having said at least one standardized zone thereon.

33. The combination as defined by claim 24 wherein said blocking means is a projection having a substantially triangular cross-section.

34. The combination as defined by claim 24 wherein said blocking means is a projection having a substantially semi-circular cross-section.

35. The combination as defined by claim 24 wherein said blocking means is a projection in the form of a parallelepiped.

36. In combination a modified universal binding adapted to be mounted on a ski, said modified universal binding comprising at least one jaw for securing said boot to said ski and a ski boot comprising at each of its ends at least one standardized retention and release zone comprising means for engaging at least one corresponding standardized retention and release zone on said jaw of said binding to allow for the insertion of said boot and the safe maintenance of said boot on said ski, wherein at least one of the ends of said boot comprises a blocking means adapted to engage a corresponding portion provided on said jaw of said binding in a manner so as to allow for the utilization of said boot only with modified bindings having standardized retention and release zones adapted whereby the blocking means does not interfere with insertion of said boot, wherein said boot has an anti-skid surface on the sole thereof wherein said binding further comprises an intermediate plate adapted to be positioned between said boot and said ski to facilitate release of said boot when a force is exerted on said boot.

37. The combination as defined by claim 24 wherein said blocking means comprises means for preventing said blocking means from being laterally retained by said modified universal binding.

38. The combination as defined by claim 24 wherein said jaw comprises means for laterally retaining said boot without laterally retaining said blocking means.

39. The combination as defined by claim 24, wherein said jaw comprises means for retaining said boot without vertically retaining said blocking means.

40. The combination as defined by claim 24 wherein said standardized retention and free zones conform to ONORM and/or DIN standards.

41. The combination as defined by claim 40 wherein said standardized retention and free zones conform to ONORM standard S4035 and S4036.

42. The combination as defined by claim 40 wherein said standardized retention and free zones conform to DIN standards 7880, parts 1 and 2.

43. In combination a modified universal binding adapted to be mounted on a ski, said modified universal binding comprising:

(a) a front jaw and a rear jaw for securing said boot to said ski, and a pivotable plate, said rear jaw being mounted on said pivotable plate, said pivotable plate being mounted to pivot around a vertical axis at the front of said binding; and (b) a ski boot having an anti-slip sole comprising at each of its ends a standardized retention and release zone comprising means for engaging at least one corresponding standardized retention and release zone on the corresponding jaw of said binding to allow for the insertion of the boot and the safe maintenance of the boot on the ski, and wherein at least one of the ends of said boot comprises a blocking means adapted to engage a corresponding portion on the corresponding jaw in a manner so as to allow for the utilization of the boot only with modified bindings having standardized retention and release zones adapted whereby the blocking means permits insertion of the boot into the binding having said portion corresponding to said blocking means.

44. The combination as defined by claim 43 wherein said blocking means comprises a protrusion extending towards one of said jaws.

45. The combination as defined by claim 43 wherein said blocking means comprises means for preventing said blocking means from being laterally retained by said modified universal binding.

46. The combination as defined by claim 43, wherein said jaw comprises means to prevent said blocking means from being vertically retained by said modified universal binding.

47. The combination as defined by claim 43 wherein said standardized retention and free zones conform to ONORM and/or DIN standards.

48. The combination as defined by claim 43 wherein said jaw comprises means for laterally retaining said boot without laterally retaining said boot by cooperation of said jaw with said blocking means.

49. The combination as defined by claim 43 wherein standardized retention and free zones conform to ONORM and/or DIN standards.

50. The combination as defined by claim 49 wherein said standardized retention and free zones conform to ONORM standard S4035 and S4036.

51. The combination as defined by claim 49 wherein said standardized retention and free zones conform to DIN standards 7880, parts 1 and 2.

52. A method of preventing a ski boot, comprising standardized retention and free zones, from being inserted into a binding adapted to secure a ski boot having standardized retention and free zones onto a ski, said method comprising the step of providing blocking means on said ski boot, thereby preventing said ski boot from being secured by bindings lacking means for receiving said blocking means, wherein said step of providing blocking means on said ski boot comprises molding a projection onto a portion of said ski boot.

53. The method defined by claim 52 wherein said step of providing blocking means on said ski boot comprises providing a projection on said ski boot to thereby project into at least one retention and free zone of said binding.

54. The method defined by claim 53 wherein said step of providing blocking means on said ski boot comprises providing a projection on the rear of said ski boot to thereby prevent a rear binding from securing a heel portion of said ski boot.

55. The method defined by claim 53 wherein said step of providing blocking means on said ski boot comprises providing a projection on the front of said ski boot to thereby prevent a front binding from securing a front portion of said ski boot.

56. A method of preventing a ski boot, comprising standardized retention and free zones, from being inserted into a binding adapted to secure a ski boot having standardized retention and free zones onto a ski, said method comprising the step of providing blocking means on said ski boot, thereby preventing said ski boot from being secured by bindings lacking means for receiving said blocking means, wherein said step of providing blocking means on said ski boot comprises molding a projection together with a portion of said ski boot.

57. The method defined by claim 52 wherein said step of providing blocking means on said ski boot comprises securing a projection onto said ski boot by attachment means.

58. The method defined by claim 52 wherein said step of securing a projection onto said ski boot comprises securing said projection onto said ski boot with one or more screws.

59. The method defined by claim 52 wherein said step of providing blocking means on said ski boot comprises providing a projection extending rearwardly and upwardly on a rear portion of said ski boot.

60. A method of preventing a ski boot, comprising standardized retention and free zones, from being inserted into a binding adapted to secure a ski boot having standardized retention and free zones onto a ski, said method comprising the step of providing blocking means on said ski boot, thereby preventing said ski boot from being secured by bindings lacking means for receiving said blocking means, wherein said step of providing blocking means on said ski boot comprises providing a projection having a generally rectangular cross-section on a rear portion of said ski boot.

61. The method defined by claim 52 wherein said step of providing blocking means on said ski boot comprises providing a projection having a generally triangular cross-section having a base on said ski boot and an apex projecting from said boot.

62. The method defined by claim 52 wherein said step of providing blocking means on said ski boot comprises providing a projection having a generally semi-circular surface projecting from said boot.

63. A method of preventing a ski boot, comprising standardized retention and free zones, from being inserted into a binding adapted to secure a ski boot having standardized retention and free zones onto a ski, said method comprising the step of providing blocking means on said ski boot, thereby preventing said ski boot from being secured by bindings lacking means for receiving said blocking means, wherein said step of providing blocking means on said ski boot comprises providing a projection on a rear portion of said ski boot and a space between the rear lower portion of the upper and said projection to allow for pivoting of at least a portion of said upper.

64. The method defined by claim 52 wherein said step of providing blocking means on said ski boot comprises providing said blocking means on a ski boot having an anti-skid sole.

65. A method of modifying a universal ski binding for attachment of a ski boot onto a ski to thereby permit said ski binding so modified to secure ski boots having standardized retention and free zones, as well as to secure such ski boots which include blocking means, and to prevent the use of such ski boots which include blocking means with bindings which have not been modified, said method comprising the step of modifying said binding to permit said ski binding to secure ski boots comprising said blocking means wherein said step of modifying said binding comprises modifying a binding having a pivotable plate adapted to release ski boots having an anti-slip sole.

66. The method defined by claim 65 wherein said step of modifying said binding comprises providing a seat in said binding to receive said blocking means.

67. The method defined by claim 65 wherein said binding comprises a jaw, and wherein said step of modifying said binding comprises providing a seat in said jaw of said binding.

68. The method defined by claim 67 wherein said jaw comprises a median portion and said seat is provided in said median portion.

69. The method defined by claim 68 wherein said seat is formed in a generally rectangular configuration.

70. The method defined by claim 68 wherein said seat is formed to have a generally curved configuration.

71. The method defined by claim 68 wherein said seat is formed to have a generally triangular configuration.

72. The method defined by claim 65 wherein said step of modifying said binding comprises modifying a rear binding.

73. A method for (1) preventing a ski boot, comprising standardized retention and free zones, from being inserted into a binding adapted to secure a ski boot having standardized retention and free zones onto a ski and for (2) permitting said binding to secure said ski boot to a ski comprising the steps of:

(a) providing blocking means on said boot to thereby interfere with said binding to prevent said binding from securing said ski boot onto a ski until step (b) is performed; and (b) modifying said binding to permit said binding to secure said ski boot onto said ski both before and after step (a) is performed, wherein said blocking means is provided on a ski boot having an anti-skid sole, and wherein binding comprising a pivotable plate is so modified.

74. The method defined by claim 73 wherein said blocking means is formed as a projection which projects into said binding.

75. The method defined by claim 73 wherein said step of modifying comprises forming a receptor seat having a configuration substantially complementary to the configuration of said blocking means.

76. A method for (1) preventing a ski boot, comprising standardized retention and free zones, from being inserted into a binding adapted to secure a ski boot having standardized retention and free zones onto a ski and for (2) permitting said binding to secure said ski boot to a ski comprising the steps of:

(a) providing blocking means on said boot to thereby interfere with said binding to prevent said binding from securing said ski boot onto a ski until step (b) is performed; and (b) modifying said binding to permit said binding to secure said ski boot onto said ski both before and after step (a) is performed by forming a receptor seat having a configuration substantially complementary to the configuration of said blocking means, wherein said blocking means is formed as a projection comprising two lateral retention surfaces and said receptor seat is formed to comprise surfaces which cooperate with said lateral retention surfaces to thereby ensure lateral retention of said ski boot on said ski.

77. The method defined by claim 73 wherein said blocking means is provided and said binding is modified so that said blocking means is not substantially laterally retained by said binding.

78. The method defined by claim 73 wherein said blocking means is provided and said binding is modified so that said blocking means is not substantially vertically retained by said binding.

79. The method defined by claim 73 wherein said blocking means is formed as a projection at the front of said ski boot and said binding is modified to comprise a receptor seat for receiving said projection.

80. The method defined by claim 79 wherein said blocking means is provided on the front of said ski boot.

81. The method defined by claim 79 wherein said blocking means is formed as a projection and wherein said binding is modified to comprise a free space for reception of said projection, whereby said ski boot is not laterally secured within said binding by means of said projection.

82. The method defined by claim 80 wherein said blocking means is formed as a projection and wherein said binding is modified to comprise a free space for reception of said projection, and a recess is formed to permit said projection to move downwardly toward said binding.

83. The method defined by claim 73 wherein said blocking means is formed as an irregular truncated pyramid having its major base attached to a front portion of said upper of said ski boot and its minor base projecting from said ski boot.

84. The method defined by claim 73 wherein said blocking means is formed as a projection having a generally triangular cross-section.

85. The method defined by claim 73 wherein said blocking means is formed as a projection having a generally semi-circular cross-section.

86. A method for (1) preventing a ski boot, comprising standardized retention and free zones, from being inserted into a binding adapted to secure a ski boot having standardized retention and free zones onto a ski and for (2) permitting said binding to secure said ski boot to a ski comprising the steps of:

(a) providing blocking means on said boot to thereby interfere with said binding to prevent said binding from securing said ski boot onto a ski until step (b) is performed wherein said blocking means is formed as a projection in the form of a parallelepiped; and (b) modifying said binding to permit said binding to secure said ski boot onto said ski both before and after step (a) is performed.

87. The ski boot as defined by claim 1 wherein said boot comprises a portion having a predetermined functional characteristic and said blocking means comprises means for designating said boot as having said predetermined functional characteristic.

88. The ski boot as defined in claim 87 wherein said functional characteristic is independent of said blocking means.

89. The ski boot defined in claim 88 wherein said blocking means prevents said boot from being secured in bindings which are functionally incompatible with said boot having said predetermined functional characteristic.

90. The ski boot as defined in claim 89 wherein said functional characteristic comprises an anti-skid sole.

* * * * *